United States Patent [19]

Bahr et al.

[11] 4,381,322

[45] Apr. 26, 1983

[54] PROCESS FOR PRODUCING A SLIDING LAYER ON THE SURFACE OF AN ALUMINUM-COATED RECORD CARRIER

[75] Inventors: Dietrich J. Bahr, Herrenberg; Marian Briska, Böblingen, both of Fed. Rep. of Germany

[73] Assignee: International Business Machines Corporation, Armonk, N.Y.

[21] Appl. No.: 304,224

[22] Filed: Sep. 21, 1981

[30] Foreign Application Priority Data

Oct. 28, 1980 [DE] Fed. Rep. of Germany ..... 3040485

[51] Int. Cl.[3] ..... B05D 3/10; B05D 5/08

[52] U.S. Cl. ..... 427/179; 427/209; 427/250; 427/296; 427/333

[58] Field of Search ..... 427/177, 178, 179, 333, 427/411, 419.8, 209, 250, 296

[56] References Cited

U.S. PATENT DOCUMENTS

| | | | |
|---|---|---|---|
| 2,971,862 | 2/1961 | Baer et al. | 427/250 |
| 3,463,659 | 8/1969 | Dragoon et al. | 427/250 |
| 3,620,831 | 11/1971 | Gould | 427/121 |
| 3,698,932 | 10/1972 | Dean | 427/419.8 X |
| 3,786,518 | 1/1974 | Atherton | 428/331 |
| 4,082,594 | 4/1978 | Stonehouse | 427/250 |

*Primary Examiner*—Evan K. Lawrence

*Attorney, Agent, or Firm*—Joseph G. Walsh

[57] ABSTRACT

To reduce scratches on the aluminum-covered front surface of a record carrier substrate having a back surface covered with a nitrocellulose lacquer, 0.1 to 2 percent by weight of a fatty acid, as referred to the weight of the wet lacquer, is added to the last applied layer of lacquer. When the record carrier is wound into a roll, the aluminum layer contacts and reacts with the fatty acid forming a sliding layer.

3 Claims, No Drawings

PROCESS FOR PRODUCING A SLIDING LAYER ON THE SURFACE OF AN ALUMINUM-COATED RECORD CARRIER

DESCRIPTION

1. Technical Field

The present invention concerns a process for generating a sliding layer on the aluminum-coated front surface of a record carrier substrate having a nitrocellulose lacquer layer on the back surface of the substrate by the action of one or several fatty acids with the aluminum layer.

2. Background Art

In the German Patent Application No. P 30 07 331.5, now commonly owned U.S. Patent Application Ser. No. 202,548, abandoned, a process has been proposed by the present inventors for at least partially converting aluminum layers into aluminum salts of a fatty acid on an aluminum-coated record carrier, wherein during or after deposition of the aluminum layer, the aluminum, with the vapor of a fatty acid being simultaneously present, is at least partially converted, the degree of conversion being determined by the partial pressure of the fatty acid. It has been proposed in particular to use an oleic acid as a fatty acid, whereby conversion is effected to produce aluminum oleate molecules which are formed on the surface of the layer and which are also deposited therein.

It has been proposed further in said application that the aluminum layer be converted during and/or after coating in a vacuum.

It has been found that in so far as the sliding layer to be arranged on the surface of the aluminum layer and its effect on reducing scratches and traces of abrasion on the surface of the aluminum layer during printing in an electroerosion printer are concerned, the results obtainable by said process are quite satisfactory, but that the low vapor pressure of the oleic or fatty acids in a vacuum, and the short reaction period of the oleic or fatty acids on the aluminum layer, do not permit a sliding layer which is improved still further.

During previous tests it has been found that the papers used as a substrate for known aluminum-coated record carriers obviously contained active components which in the course of time caused the surface of the aluminum layer to react with the materials contained in the paper, so that after a longer shelf life the sliding properties of said surface were excellent. Further extensive tests eventually led to the theory in accordance with Patent Application No. P 30 07 331.5, according to which oleic acid or tall oil, i.e., mixtures of different fatty acids, are made to react on the aluminum layer.

DISCLOSURE OF THE INVENTION the above-mentioned results in accordance with the previous proposal, which are not fully satisfactory, gave rise to the desire to still further improve and intensify the reaction on the aluminum layer. In accordance with the present invention this is achieved in that, prior to the application of an aluminum layer on the front surface of the record carrier substrate, the back surface of the substrate is coated with one or several nitro lacquer layers, 0.1 to 2 percent by weight, as referred to the wet lacquer, of one or several fatty acids are added to the respective last lacquer layer, and that subsequently after the material has been aluminum-coated in a vacuum, the record carrier material is wound up in the form of a roll, and that the roll thus produced is subjected to an aging period of one month or more. For this purpose, preferably 0.1 to 2 percent by weight of an oleic acid or a mixture of several fatty acids, such as tall oil, are added.

To this end, the paper is front-coated in a conventional manner, preferably using nitro lacquer which, depending upon the requirements, is dyed or pigmented. In addition, one or several layers of a nitro lacquer are applied to the back side, adding to the respective last layer 0.1 to about 2.0 percent of a fatty acid or a mixture of fatty acids. It is of special importance for this lacquer layer to be applied as the last layer in the overall process. As in many cases, aluminum-coated record carriers are lacquered on their back side so that the printed paper is absolutely opaque and prevented from curling up, etc., such a measure can be implemented at no extra cost.

After the front side of the record carrier material has been coated with aluminum, or aluminum has been deposited onto it in a vacuum, this largely oxide-free aluminum layer comes into close contact with the fatty acids on the backside, so that conversion is initiated immediately. As the roll is wound very tightly, this action continues for a long time outside the vacuum chamber. In contrast to the process proposed in the above-mentioned Patent Application, according to which the aluminum layer is converted by means of fatty acids during manufacture, the fatty acid in the lacquer on the back side remains effective many months after manufacture of the paper, so that apart from the formation of a sliding layer, there are a number of long-term reactions, such as surface polymerization, rendering the soap layer mechanically resistant.

It is also pointed out that the lacquer layer below the aluminum layer is not serviceable immediately after the record carrier material has been aluminum-coated, but that curing of the lacquer necessitates a longer shelf life of one or several months of the rolls thus wound. During this time, the fatty or the oleic acids, the mixtures of fatty acids, or the tall oil contained in the lacquer on the back side are permitted to simultaneously react on the aluminum layer.

It has been found that the basic concept disclosed in German Patent Application No. P 30 07 331.5 can be implemented even more effectively by means of this novel process, and that the aluminum layers thus have a much higher resistance.

We claim:

1. A process for forming a record carrier having a sliding layer on an aluminum-coated front surface of a substrate having a nitrocellulose lacquer layer, said process comprising the steps of:

(1) coating the back surface of the substrate with one or several nitrocellulose lacquer layers with from about 0.1 to 2% by weight, as referred to the wet lacquer, of one or several fatty acids being added to the last lacquer layer, (2) coating the front surface of the substrate with aluminum in a vacuum;

(3) winding the record carrier into the form of a roll, whereby the aluminum layer is in contact with the fatty acid, and a sliding layer is formed by reaction between the aluminum layer and the fatty acid, and (4) aging the roll for at least one month.

2. A process as claimed in claim 1 wherein the fatty acid is oleic acid.

3. A process as claimed in claim 1 wherein the fatty acid is tall oil.

* * * * *